US005473920A

United States Patent [19]

Goldman

[11] Patent Number: 5,473,920

[45] Date of Patent: Dec. 12, 1995

[54] MANIPULATION PROOF COMBINATION LOCK

[75] Inventor: Ilan Goldman, Herzliya, Israel

[73] Assignee: Ilco Unican, Inc., Quebec, Canada

[21] Appl. No.: 257,918

[22] Filed: Jun. 10, 1994

[51] Int. Cl.[6] ..... E05B 37/08

[52] U.S. Cl. ..... 70/303 A; 70/320

[58] Field of Search ..... 70/301, 302, 303 R, 70/303 A, 320–322, 333 R

[56] References Cited

U.S. PATENT DOCUMENTS

| | | | |
|---|---|---|---|
| 2,660,873 | 12/1953 | Bennett et al. | 70/303 A |
| 3,045,466 | 7/1962 | Herlong | 70/303 A |
| 3,991,596 | 11/1976 | Gartner | 70/303 A |
| 4,328,689 | 5/1982 | Keller et al. | 70/303 A |
| 4,722,207 | 2/1988 | Wertz, Jr. | 70/303 A |
| 4,756,176 | 7/1988 | Uyeda | 70/303 A |
| 4,910,981 | 3/1990 | Gartner | 70/303 A X |

*Primary Examiner*—Lloyd A. Gall
*Attorney, Agent, or Firm*—Hill, Steadman & Simpson

[57] ABSTRACT

A combination lock is provided having a housing with a lock dial shaft rotatably mounted thereto. A lock bolt is slidably mounted to the housing, and a fence lever is pivotally coupled to the lock bolt. A tension spring constantly urges the fence lever into an operative, lock bolt displacing position thereof. An assembly of gated tumbler wheels is rotatable by the lock dial shaft and a slotted disc is mounted on a tumbler wheels assembly. The fence lever is adapted to close against the gated tumbler wheels when in alignment and thereby enabling the displacement of the lock bolt by the fence lever. A displaceable spring cam plate is coupled to a cam disc associated with the slotted disc so that, on every revolution of the cam disc, the plate becomes displaced a short distance. A second spring coupled between the fence lever and the cam plate is effective in the non-displaced position of the plate to restrain the pivoted movement of the fence lever under the tension of its spring. In the displaced position of the plate, the fence lever is allowed to pivot into the operative position thereof.

4 Claims, 3 Drawing Sheets

MANIPULATION PROOF COMBINATION LOCK

BACKGROUND OF THE INVENTION

The present invention generally relates to tumbler scrambling combination locks. More specifically, the present invention relates to manipulation proof combination locks.

It has long been recognized that combination locks, based on the operation of an articulated, spring biased fence lever, are liable to be tampered with by skilled manipulators. Examples of such combination locks are shown in U.S. Pat. Nos. 3,991,596; 4,722,207; 4,756,176; and others.

A number of solutions have been proposed to alleviate this problem. One common solution to render the locks "manipulation proof" is based on the idea of avoiding the sequential contact of the fence lever with the rotatable tumbler wheels, one at a time during dialing. Allowing the snapping of the lever into engagement with all of the tumbler wheels upon completion of the combination was indicative of the correct combination.

Various arrangements and mechanisms have thus been proposed to solve this problem. The proposed arrangements and mechanisms are, however, rather complicated in design. A need, therefore, exists for an improved tumbler scrambling combination lock which is manipulation proof.

SUMMARY OF THE INVENTION

According to the present invention, in an embodiment, a combination lock is provided including a housing with a lock dial shaft rotatably mounted thereto, a lock bolt slidably mounted to the housing, a fence lever pivotally coupled to the lock bolt, a tension spring constantly urging the fence lever into an operative, lock bolt displacing position thereof, an assembly of gated tumbler wheels rotatable by the lock dial shaft, a slotted disc mounted on the tumbler wheels assembly, the fence lever being adapted to close against the gated tumbler wheels when in alignment therewith and thereby enabling the replacement of the lock bolt by the fence lever, a displaceable spring cam plate coupled to a cam disc associated with the slotted disc so that, on every revolution of the cam disc, the plate becomes displaced a short distance, a second spring coupled between the fence lever and the cam plate, effective, in the non-displaced position of the plate, to restrain the pivoted movement of the fence lever under the tension of its spring, and in the displaced position of the plate, to allow the pivoted movement of the fence lever into operative position thereof.

In an embodiment, the second spring of the combination lock is a wire spring.

In an embodiment, the spring cam plate is coupled to the cam disc by an opening of a generally closed U-shape. The cam disc is circular with a removed segment portion engageable with the closed side of the opening.

It is, therefore, an advantage of the present invention to provide a simple combination lock which overcomes the deficiencies of prior art locks.

Further, an advantage of the present invention is to provide a combination lock providing a simple, straightforward solution to avoid manipulation thereof.

A further advantage of the present invention is to provide a combination lock having means distinct therefrom such that the means may be installed in most types of commercially available combination locks rendering those locks manipulation proof.

These and other advantages of the present invention will be described in and will be apparent from the detailed description of the presently preferred embodiments and from the drawings.

BRIEF DESCRIPTION OF THE DRAWINGS

The present invention, together with further objects and attendant advantages thereof, may best be understood by reference to the following description taken in conjunction with the accompanying drawings in which.

DETAILED DESCRIPTION OF THE PRESENTLY PREFERRED EMBODIMENTS

Figure 1:
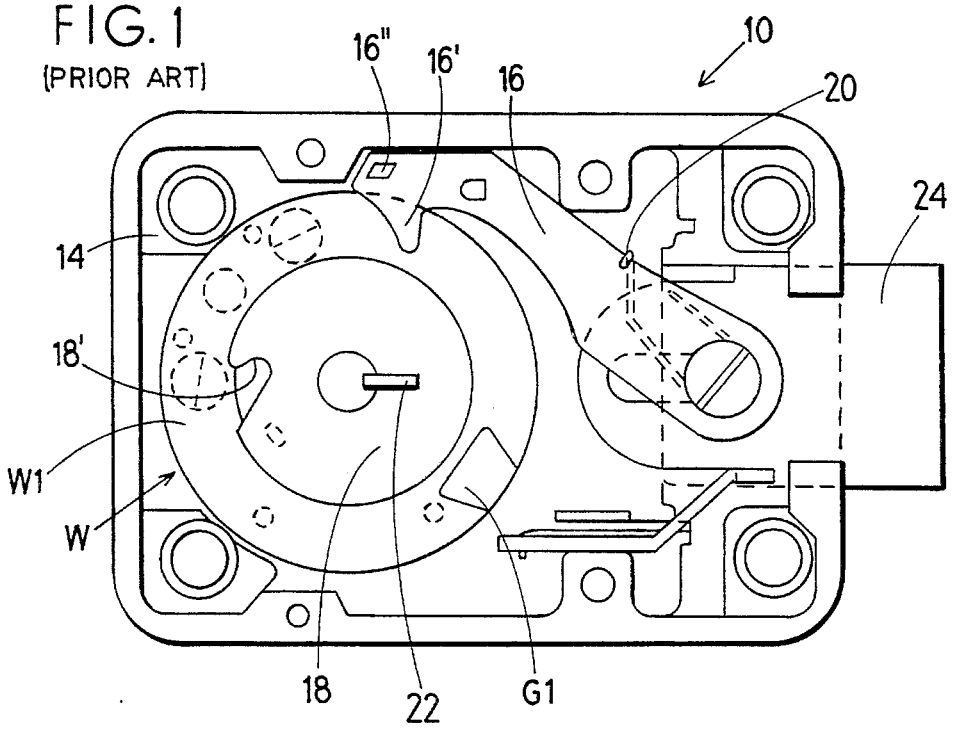
FIG. 1 (PRIOR ART)
FIG. 1 illustrates a plan view of a conventional, non-manipulation proof combination lock (with its cover removed).

Referring to FIG. 1, a conventional combination lock mechanism is shown and is generally designated at 10 and is disposed within a housing. As is generally known, the mechanism 10 comprises a plurality of tumbler wheels, generally designated W (the upper, exposed tumbler wheel is designated W1). The upper tumbler wheel W1 is axially mounted and is coupled to a lock shaft 14. Every tumbler wheel is provided with a recess or a gate G (for example, the tumbler wheel W1 comprises a gate G).

Upon completion of dialing of the pre-set combination by the lock shaft 14, the gates G of all wheels become aligned, so that a fence arm feeler pin 16" (shown only from above) can enter into the space of the gates G and, thereby, a nose 16' of a pivoted, spring-urged fence lever 16 enters a cam slot 18' of a driver disc 18. A spring 20 is coupled to the fence lever 16 for normally urging the fence lever 16 into its active, gates penetrating position.

The driver disc 18 is keyed to the lock shaft 14 by a key 22. Turning the lock shaft 14 from the outside of a door, for example, a dial knob (not shown) causes the withdrawal of a lock bolt 24 to open the door. All of these features of construction and operation are well known and need not be further described in the context of the present invention.

Figure 2:
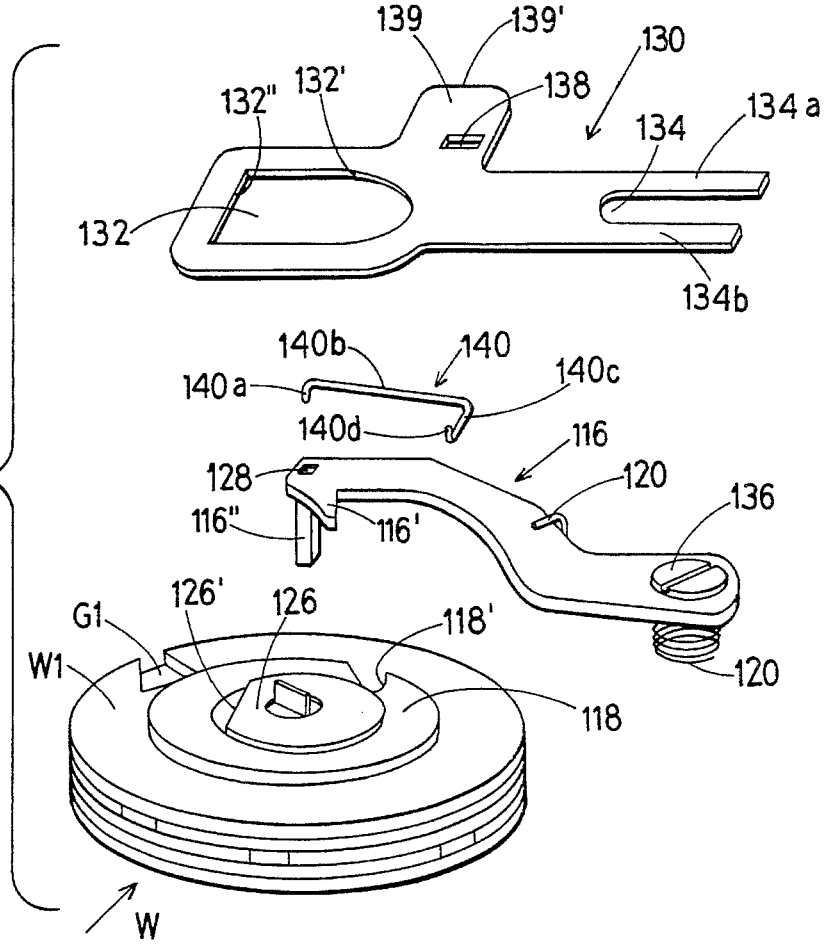
FIG. 2 illustrates a schematic, two-dimensional, exploded view of main components of a lock provided according to a preferred embodiment of the present invention.

Turning now to FIG. 2, a plurality of tumbler wheels W, each provided with their respective gates G is illustrated. A driver disc 118, as provided according to the present invention, is a smaller diameter than the disc 18 of the conventional lock mechanism illustrated in FIG. 1. Furthermore, the disc 118 is formed with an upwards protruding, concentric cam disc 126 (which may conveniently be integrally made with the driver disc 118). The cam disc 126 is circular except for a segment 126' which is removed or cut away as shown. The location of the segment 126' relative to a fence lever nose engaging recess 118' is pre-set according to a functional consideration as will be explained below.

A fence lever 116 having a fence feeler pin 116" further comprises a tiny bore 128 for a purpose to be described further below.

Further provided is a cam spring plate generally designated at 130. The cam spring plate 130 comprises a generally U-shaped opening 132, configured at one side with a radius 132' somewhat larger than that of the cam disc 126. At its other side, the U-shaped opening 132 has a linear surface 132". The cam spring plate 130 further comprises at its other end a U-shaped cut-off 134 configured to slidingly receive between its legs 134*a* and 134*b* a head portion of a bolt 136.

An opening 138 which is preferably, but not necessarily elongated, is provided in the cam spring plate 130 at a portion 139 thereof which extends in the direction of a respective housing wall (see FIG. 4), and comprises a linear surface 139'.

Finally, according to the present invention, a profiled wire spring 140 is provided comprising four portions 140*a*, 140*b*, 140*c* and 140*d* which portions are bent relative to each other as shown. In the assembled state, the portion 140*a* is inserted from above into the opening 128 of the fence lever 116, and the portion 140*d*, in turn, is inserted from below into the opening 138 of the cam spring plate 130.

The operation of the improved lock 110 will now be 10 described with reference to FIGS. 3 and 4.

In the assembled state of the lock 110, the tension of the wire spring 140 is such that, in one position of the plate 130 relative to the fence lever 116 (as explained below), the spring 140 overcomes the force of a spring 120, and in another position of the plate 130, the spring 120 overcomes the attraction of the spring 140.

In the assembled state of the lock 110, the cam spring plate 130 is seated over both the driver disc 118 and the fence lever 116. The cam disc 126 freely fits into the opening 132, and the bolt 136 fits into the cut-out 134. The spring 140 is installed as described above so that in the depicted, inoperative position of the lock, the lever 116 is constantly pushed away from the tumbler wheels engaging position, i.e. neutralizing the force of the spring 120. Therefore, as long as the plate 130 is stationary, no contact will be made between the lever 116 and the driving disc 118.

During rotation of the driver disc 118 (and of the cam disc 126) by the dial shaft 114 in the conventional manner, the cam plate 130 remains in fact stationary, except for when the cut-away segment 126' becomes operative (see FIG. 4) namely once on every full rotation. At such point, the displacement of the plate 130 by a small distance (to the right) will allow a momentary contact of the fence feeler pin 116" against the rim of the tumbler W—or of the nose 116' into the engaging recess 118', if the proper combination dialing has been completed.

As is known, the manipulation tampering method is based on the fact that the nose 16' of the fence lever 16 (FIG. 1) becomes released from the outer contour of the driver disc 18, to somewhat enter into and then withdraw from the slot 18', in a cyclic fashion, and that the skilled manipulator is able to detect these two occurrences ("contact points").

It is thus clear that due to the operation of the spring cam plate 130 of the present invention, such a tampering method is completely obviated.

Once the complete alignment of the gates G is achieved according to the normal dialing procedure, the dial shaft must be rotated in a reverse direction (from the "0" position). The nose portion 116' will become engaged by the cam slot 118', and the lock bolt 124 may thus be displaced into its unlocked, withdrawn position as illustrated in FIG. 4.

The application of the present invention is both simple and low-cost. It involves the addition of only two additional components (cam spring plate 130 and spring 140) and a minor alteration of the driver disc 18. Therefore, the general design of the conventional lock is not upset whatsoever, which renders the incorporation of the extra parts in most existing models of non-manipulation proof combination locks fairly convenient.

Referring now to FIGS. 5–9, an alternate embodiment of a lock of the present invention is illustrated and generally designated at 210. A driver disc 218 is provided having a smaller diameter than the disc 18 of the conventional lock mechanism illustrated in FIG. 1. The disc 218 includes an upwards protruding, concentric cam disc 226 which may be integrally formed with the driver disc 218. A portion 226' of the cam disc 226 is cut away. The location of the portion 226' is pre-set as previously discussed with respect to the embodiment illustrated in FIG. 2 and with respect to a fence lever nose engaging recess 218'.

A fence lever 216 is further provided having a nose 216' and a tiny bore 228 for the purpose described with reference to FIG. 2. A cam spring plate 230 is also provided having a U-shaped opening 232 with a radius 232' somewhat larger than the cam disc 226. At the other side of the opening 232 is a linear surface 232". The cam spring plate 230 further has a U-shaped cut-off 234 configured to receive between its legs 234*a*, 234*b*, in a sliding fashion, a head portion of a bolt 236.

An opening 238 which is preferably, but not necessarily, elongated is provided in the cam spring plate 230 at a portion 239 thereof which extends into the direction of a respective housing wall (see FIG. 9), and comprises a linear surface 239'.

Figure 8:
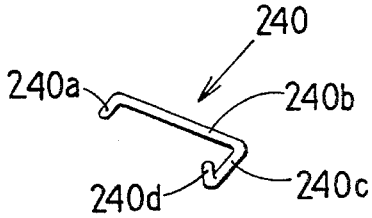
FIG. 8 illustrates a plan view of a profiled wire spring according to another embodiment of the present invention.
Figure 9:
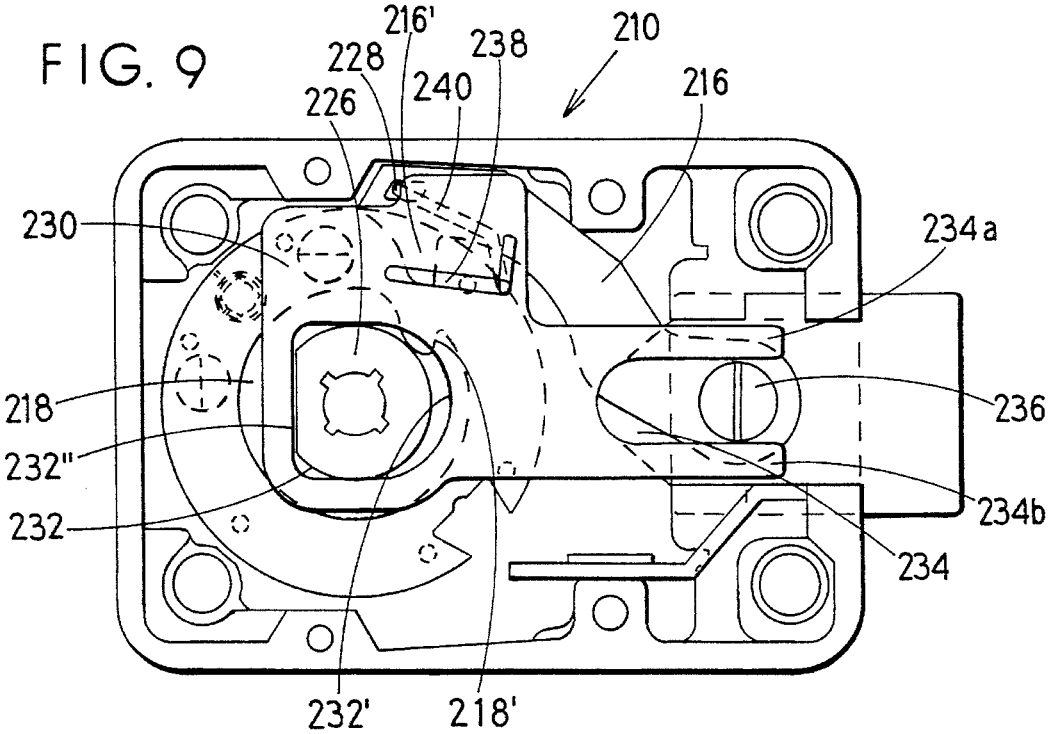
FIG. 9 illustrates a plan view of the lock of the present invention illustrating the components of Figures 5–8 in an assembled arrangement with the lock in the operative position.

A wire spring 240 is also provided having four portions 240*a*, 240*b*, 240*c* and 240*d*. The portions are bent relative to each other as shown in FIG. 8. In the assembled state, the portion 240*a* is inserted into the opening 228 of the fence lever 216, and the portion 240*d* is inserted from below into the opening 238 of the spring cam plate 230.

Figure 3:
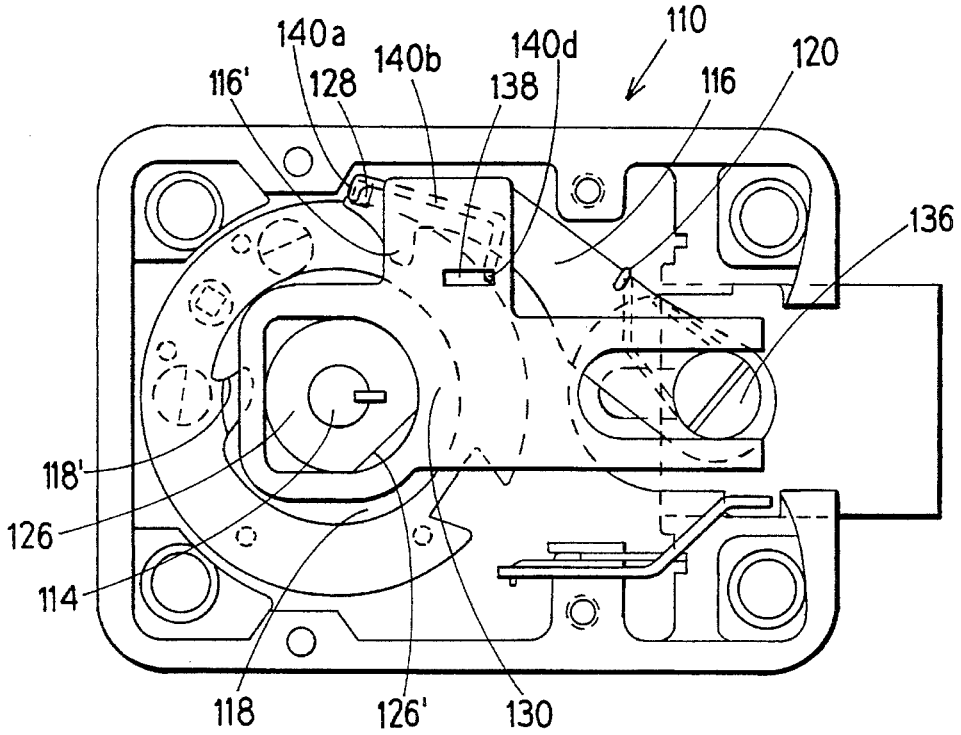
FIG. 3 illustrates a plan view of the lock of the present invention incorporating the components illustrated in FIG. 2 in a non-operative position.
Figure 4:
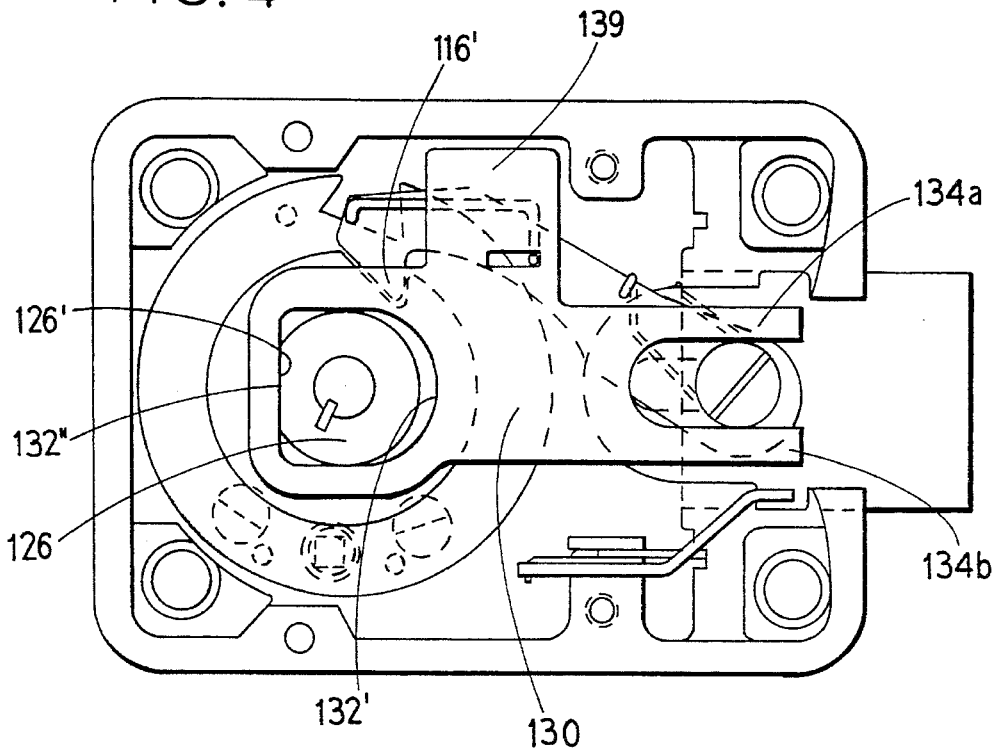
FIG. 4 illustrates a plan view of the lock of the present invention as illustrated in FIG. 3 except in the operative position thereof.
Figure 5:
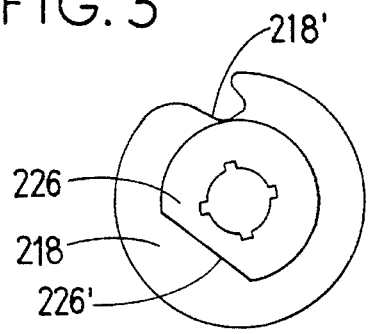
FIG. 5 illustrates a plan view of a driver disc and a concentric cam disc according to another embodiment of the present invention.
Figure 6:
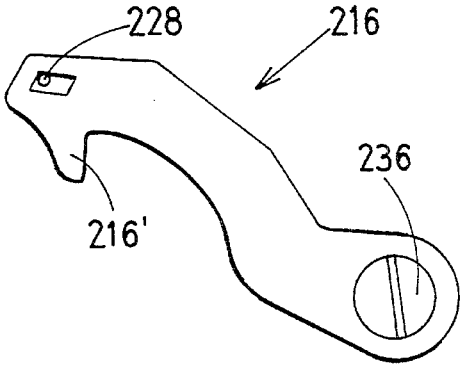
FIG. 6 illustrates a plan view of a fence lever according to another embodiment of the present invention.
Figure 7:
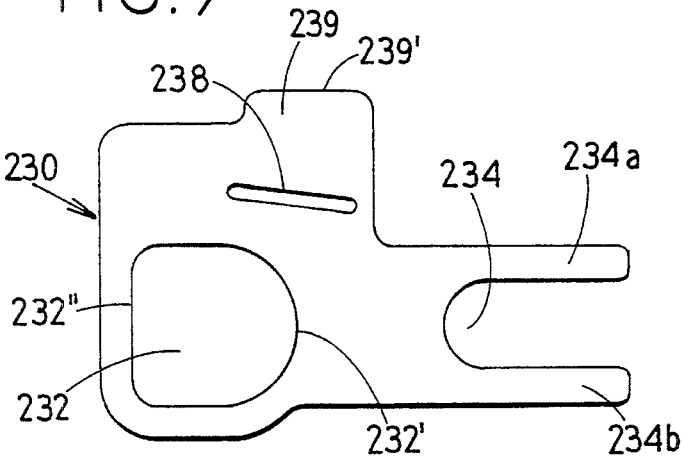
FIG. 7 illustrates a plan view of a cam spring plate according to another embodiment of the present invention.

The operation of the lock 210 is substantially identical to the operation of the lock 110 shown and described in FIGS. 3 and 4.

Therefore, it should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A combination lock comprising:

a housing;

a lock dial shaft rotatably mounted to the housing;

a fence lever pivotally coupled to a lock bolt;

a tension spring constantly urging the fence lever into an operative, lock bolt displacing position;

an assembly of gated tumbler wheels rotatable by the lock dial shaft;

a slotted disc mounted on the assembly of gated tumbler wheels wherein the fence lever is adapted to close against the assembly of gated tumbler wheels when in alignment therewith and thereby enable the displacement of the lock bolt by the fence lever;

a displaceable spring cam plate coupled to a cam disc associated with the slotted disc so that on every revolution of the cam disc the plate becomes displaced; and a second spring coupled between the fence lever and the cam plate wherein the second spring is effective, in a non-displaced position of the plate, to restrain the pivoted movement of the fence lever under tension and in a displaced position of the plate, to allow the pivoted movement of the fence lever into the operative position thereof.

2. The combination lock of claim 1 wherein the second spring is a wire spring.

3. The combination lock of claim 1 wherein the spring cam plate is coupled to the cam disc by an opening of a generally closed U-shape.

4. The combination lock of claim 3 wherein the cam disc is circular with a removed segment portion engageable with a closed side of the opening.

* * * * *

UNITED STATES PATENT AND TRADEMARK OFFICE

CERTIFICATE OF CORRECTION

PATENT NO. : 5,473,920

DATED : Dec. 12, 1995

INVENTOR(S) : ILAN GOLDMAN

It is certified that error appears in the above-indentified patent and that said Letters Patent is hereby corrected as shown below:

IN COLUMN 2, LINE 51: delete "G)." and replace with "Gl).".

IN COLUMN 3, LINE 34: delete "be 10" and replace with "be".

Signed and Sealed this

Fourth Day of June, 1996

Bruce Lehman

*Attest:*

BRUCE LEHMAN

*Attesting Officer*

*Commissioner of Patents and Trademarks*